United States Patent [19]

Ohtaka

[11] Patent Number: 5,056,346

[45] Date of Patent: Oct. 15, 1991

[54] METHOD AND DEVICE FOR MANUFACTURING BELLOWS PIPE

[75] Inventor: Mitsumasa Ohtaka, Aichi Prefecture, Japan

[73] Assignee: Usui Kikusai Sangyo Kaisha, Limited, Japan

[21] Appl. No.: 458,899

[22] Filed: Dec. 29, 1989

[30] Foreign Application Priority Data

Dec. 30, 1988 [JP] Japan ..... 63-332184

[51] Int. Cl.[5] ..... B21D 15/10

[52] U.S. Cl. ..... 72/59; 72/57

[58] Field of Search ..... 72/57, 58, 59; 29/421.1

[56] References Cited

U.S. PATENT DOCUMENTS

| | | | |
|---|---|---|---|
| 2,581,787 | 1/1952 | Dreyer | 72/59 |
| 2,954,064 | 9/1960 | De Mers | 72/59 |
| 3,083,754 | 4/1963 | De Mers | 72/59 |
| 3,130,771 | 4/1964 | Peyton | 72/59 |
| 3,339,386 | 9/1967 | Homfeldt | 72/59 |
| 3,375,689 | 4/1968 | Millar | 72/59 |
| 4,364,252 | 12/1982 | Koizumi | 72/59 |

FOREIGN PATENT DOCUMENTS

| | | | |
|---|---|---|---|
| 0532335 | 10/1956 | Canada | 72/59 |

*Primary Examiner*—David Jones

*Attorney, Agent, or Firm*—Anthony J. Casella; Gerald E. Hespos

[57] ABSTRACT

A bellows pipe is manufactured, with an elastic body pinched between a collar and a stopper inside a raw pipe being deformed, by pressing the elastic body as to expand radially such that a circumferential portion of the pipe changes to an annular convex portion, pinching and compressing the annular convex portion by a chuck and a punch to form a bellows portion, and shifting the pipe a given distance while pinching the bellows portion by the chuck. A plurality of bellows portions are successively formed in the pipe by repeating the foregoing deforming steps. Thus, a device for manufacture of the bellows pipe comprises a core member secured at one end to a support member, a collar slidably fitted on the core member, a stopper secured to the core member, an elastic body slidably fitted on the core member between the collar and the stopper, a chuck having parallel arms for pinching each bellows portion, a punch loosely fitted on the pipe, and driving cylinders for driving and shifting the collar, chuck, and punch.

5 Claims, 4 Drawing Sheets

METHOD AND DEVICE FOR MANUFACTURING BELLOWS PIPE

BACKGROUND OF THE INVENTION

1. Field of the Invention

This invention relates to a method and device for manufacturing a bellows pipe.

2. Description of the Prior Art

In the field of a method and device for manufacturing a bellows pipe, there are known Japanese Patent Publication No. 44-24746 (Bulge machining device), Japanese Patent Laid-Open No. 59-133021 (Method and device for manufacturing corrugated pipes), Japanese Patent Laid-Open No. 63-207421 (Method and device for manufacturing beaded pipe), etc.

Among them, according to Japanese Patent Publication No. 44-24746, a desired bellow portion is shaped in one step by expanding a bead portion using an inner pressure and concurrently causing axial compression using a metallic mold.

According to Japanese Patent Laid-Open No. 59-133021, two core rods with an elastic body interposed therebetween are inserted into a pipe, one core rod is pressed toward the other to deform the elastic body, a portion of the pipe is withdrawn to form an expanded angle portion, and the expanded portion is shaped to conform to a bend mold, resulting in a corrugated pipe.

According to Japanese Patent Laid-Open No. 63-207421, a pressure medium is arranged inside a work to give an inner pressure thereto, metallic molds defining a bead forming recess thereinside are provided outside the work relatively movably in the axial direction of the work, the work is put in a plastic deformable or expandable state, and the metallic molds are made close to each other, resulting in a beaded pipe.

Specifically, in the system of Japanese Patent Publication No. 44-24746, the metallic mold must be prepared so as to meet the length of the pipe and the number of beads of the bellows portion; thus, the deformable length of the pipe is limited and the metallic mold is expensive.

In the two systems of Japanese Patent Laid-Open No. 59-133021 and Japanese Patent Laid-Open No. 63-207421, the degree of freedom relating to the number of beads in the bellows portion is comparatively large; but, the pipe length, bead count and bead position are limited by reason of the structure of the core rods in the former case or of the structure of the metallic mold mounting portion in the latter case.

Further, in the latter two systems, the outer diameter and pitch of the bellows portion are limited by reason of bellows forming grooves formed in the metallic mold, thereby diminishing the degree of freedom relating to the shape of the bellows portion. In addition, since both ends of a pipe portion to be expanded are fixed by the metallic mold, the pipe cannot shift sufficiently in the axial direction during expanding, a bead top portion becomes thin, and the elastic body is severely worn because sliding be required between the pipe and the elastic body.

Further, in the latter two systems, to prevent the elastic body from protruding from a chuck portion of the metallic mold, the force of holding down the metallic mold must be set large; consequently, an excessive force is imposed on the elastic body to promote the wearing thereof, and the elastic body is compressed from the side of the molded bellows portion during continuous molding; thus, the elastic body eats into a gap of the bellows portion, thereby being damaged.

Further, in the system of Japanese Patent Laid-Open No. 63-207421, since the expanded portion together with the elastic body is compressed in the axial direction in the step of changing the expanded portion to the bellows portion, the elastic body tends to be worn or torn off, making the shape of the bellows nonuniform.

SUMMARY OF THE INVENTION

It is an object of the present invention to provide a method and device for manufacturing a bellows pipe which permits free setting of the length of a pipe and the outer diameter and pitch of a bellows portion, and prevents damage to an elastic body.

To accomplish the foregoing object, the present invention provides a method of manufacturing a bellows pipe, which comprises, with an elastic body pinched between a collar and a stopper inside a raw pipe being deformed, the first step of pressing the elastic body in the axial direction of the pipe to resiliently expand the elastic body radially of the pipe such that a circumferential portion of the pipe changes to an annular convex portion, the second step of pinching and compressing the annular convex portion by a chuck and a punch to form a bellows portion, and the third step of shifting the pipe to a given position while pinching the bellows portion by the chuck, wherein a plurality of bellows portions spaced a given distance from each other are successively formed by repeating the first to third steps.

Further, the present invention provides a device for manufacturing a bellows pipe, which comprises a support member secured on a base close to one end thereof, a core member extending along the base whose one end is secured to the support member, a collar slidably fitted on the core member on which a raw pipe being deformed is loosely fitted, a stopper secured to the extended end of the core member, an elastic body slidably fitted on the core member between the extended end of the collar and the stopper, a first drive means attached to the support member for driving the collar along the core member, a chuck having parallel arms projecting therefrom toward the core member orthogonally thereto, the spacing of these arms being previously set, a second drive means for shifting the chuck to approach and separate from the pipe, a third drive means for shifting the chuck along the pipe, a punch loosely fitted on the pipe, and a fourth drive means for shifting the punch along the pipe.

Therefore, according to the present invention, the raw pipe being deformed is fitted on the collar from the side of the stopper, and the punch is fitted on the pipe and shifted by the fourth drive means such that the point of the punch faces an end portion of the elastic body close to the collar, the foregoing processing being performed once at an initial setting stage.

Then, the second and third drive means are actuated to bring the points of the arms of the chuck into contact with the circumference of the pipe in the vicinity of the boundary between the stopper and the elastic body or slightly on the side of the elastic body.

In this state, the first drive means is actuated to shift the collar a given distance toward the stopper, resiliently expanding the elastic body radially of the pipe; as a result, an annular convex portion is formed in a circumferential portion being deformed of the pipe.

After the annular convex portion is formed in the circumference of the pipe, the first drive means is actuated to return the collar to the initial position, whereby the elastic body recovers its original shape.

Then, the fourth drive means is actuated to shift the punch a given distance toward the chuck, pinching the annular convex portion between the chuck and the punch; as a result, the annular convex portion changes to a bellows portion.

After the bellows portion is formed, the fourth drive means is actuated to separate the punch from the bellows portion, the chuck is radially retracted and shifted toward the punch, the second drive means is actuated to hold the bellows portion by the arms of the chuck, and the third drive means is actuated to shift the pipe a given distance away from the punch.

Then, by repeating the foregoing processing steps, a next bellows portion is formed adjacent to the first bellows portion in the pipe. In this way, a plurality of bellows portions spaced a given distance from each other are successively formed in the circumference of the pipe, completing a bellows pipe.

According to the present invention, the elastic body never expands into the chuck; thus, the chuck is driven only with a weak clamping force, imposing no excessive force on the elastic body during deforming.

Further, since the pipe is free shiftable on the side of the punch, the thickness of the pipe is not decreased during machining, and no tight sliding arises between the pipe and the elastic body, whereby the bellows pipe is readily manufactured. Since the elastic body never eats into the gap of the bellows portions and no groove defining the shape of the bellows portion is formed in the punch and the chuck, the bellows pipe having any desired outer diameter and thickness (pitch) for each bellows portion can be manufactured by adjusting the spacing between the punch and the chuck and the stroke of the punch.

DETAILED DESCRIPTION OF THE PREFERRED EMBODIMENTS

Embodiments of the present invention will now be described in greater detail with reference to the drawings.

Figure 1:
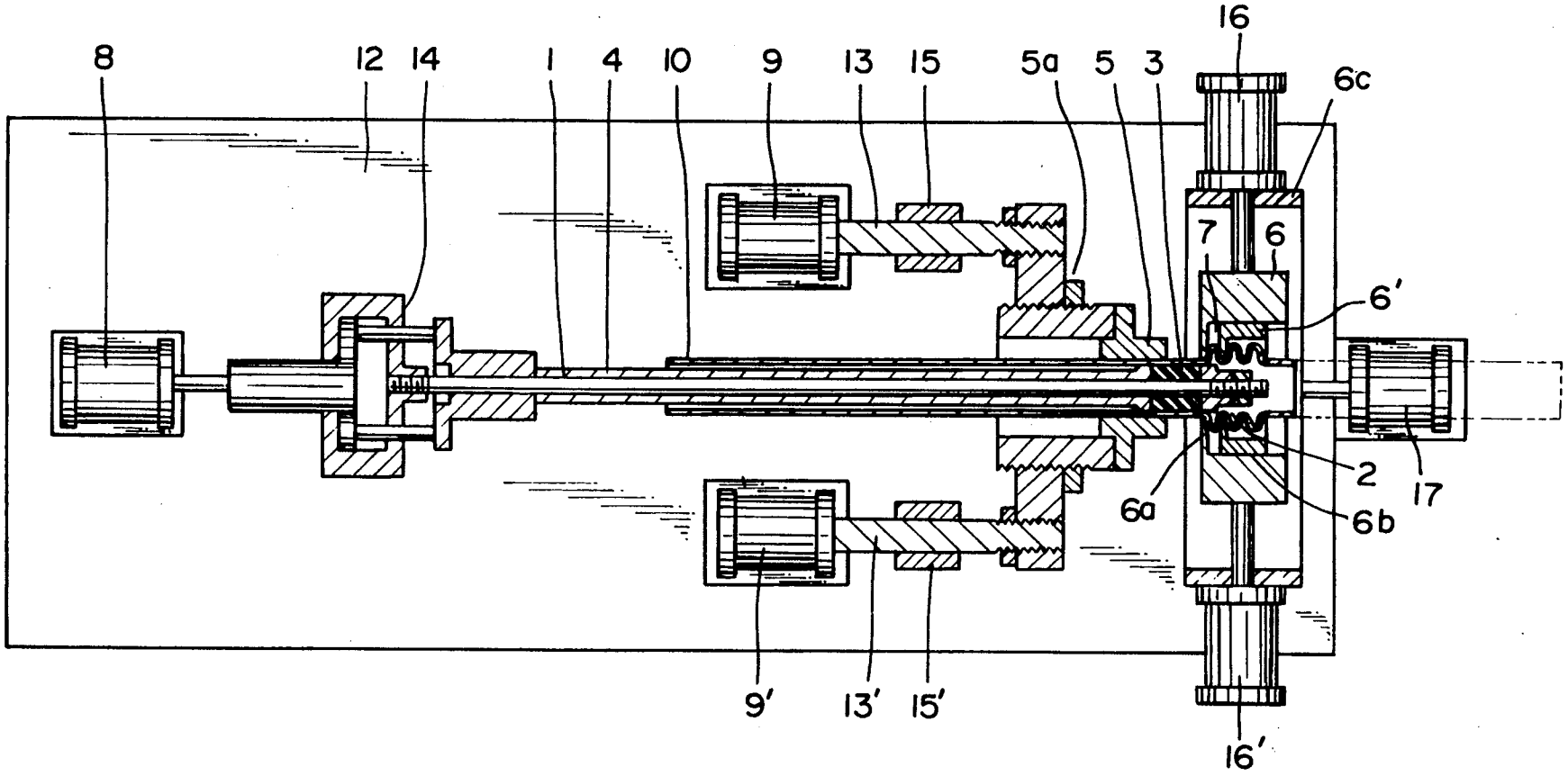
FIG. 1 is a plan view, partly in cross section, showing an embodiment of the present invention.

First, an embodiment of a device for manufacturing a bellows pipe according to the present invention will be described with reference to FIG. 1.

A base 12 has a support member 14 secured thereon at a substantial center but close to one end thereof, and a core member 1 is secured at one end to the support member 14, which extends along the base 12. A collar 4 whose inner diameter is slightly larger than the outer diameter of the core member 1 is slidably fitted on the core member 1, which is driven forward and backward along the core member 1 by a cylinder 8 mounted in the rear of the support member 14.

The other end of the core member 1 has a stopper 2 secured thereto, and an annular elastic body 3 made of urethane rubber whose inner diameter is slightly larger than the outer diameter of the core member 1 is fitted on the core member 1 between the stopper 2 and the collar 4.

The stopper 2, the elastic body 3, and an enlarged portion of the collar 4 on the side of the elastic body 3 are set substantially equal in outer diameter. Thus, a raw pipe 10 being deformed whose inner diameter is slightly larger than the outer diameter of the stopper 2, elastic body 3, and enlarged portion of the collar 4 can be inserted from the side of the stopper 2 and fitted on the stopper 2, elastic body 3 and the collar 4.

Since the thus inserted pipe 10 is loosely fitted except at the position of the enlarged portion of the collar 4, it can shift freely with respect to the collar 4.

A punch 5 whose inner diameter is slightly larger than the outer diameter of the pipe 10 loosely fitted on the collar 4 is secured to a punch support **5*a* such that the punch lies outside the pipe 10 inserted. The punch support 5*a* has punch drive shafts 13 and 13' secured thereto which are guided by shaft guides 15 and 15', and these punch drive shafts 13 and 13' are driven by cylinders 9 and 9' mounted on the base 12 in parallel to the collar 4**.

On the side of the other end of the core member 1 where the stopper 2 is secured, a chuck 6 is attached to a chuck mount **6*c* such that it lies outside the pipe 10 loosely fitted on the collar 4. The chuck 6 has parallel arms 6*a* and 6*b* projecting therefrom orthogonally to the core member 1, these arms being adapted to set the gap 7** therebetween to a desired spacing.

The chuck 6 is driven by chuck operating cylinders 16 and 16' secured to the chuck mount **6*c* so that the chuck can approach and separate from the pipe 10 loosely fitted on the collar 4. Further, the whole chuck mount 6*c* with the chuck 6 attached thereto is driven along the core member 1 by a chuck feed cylinder 17 secured to the base 12**.

Referring to the foregoing embodiment of the device for manufacturing a bellows pipe according to the present invention, an embodiment of a method of manufacturing a bellows pipe will be described with reference to FIGS. 2 through 10.

Figure 2:
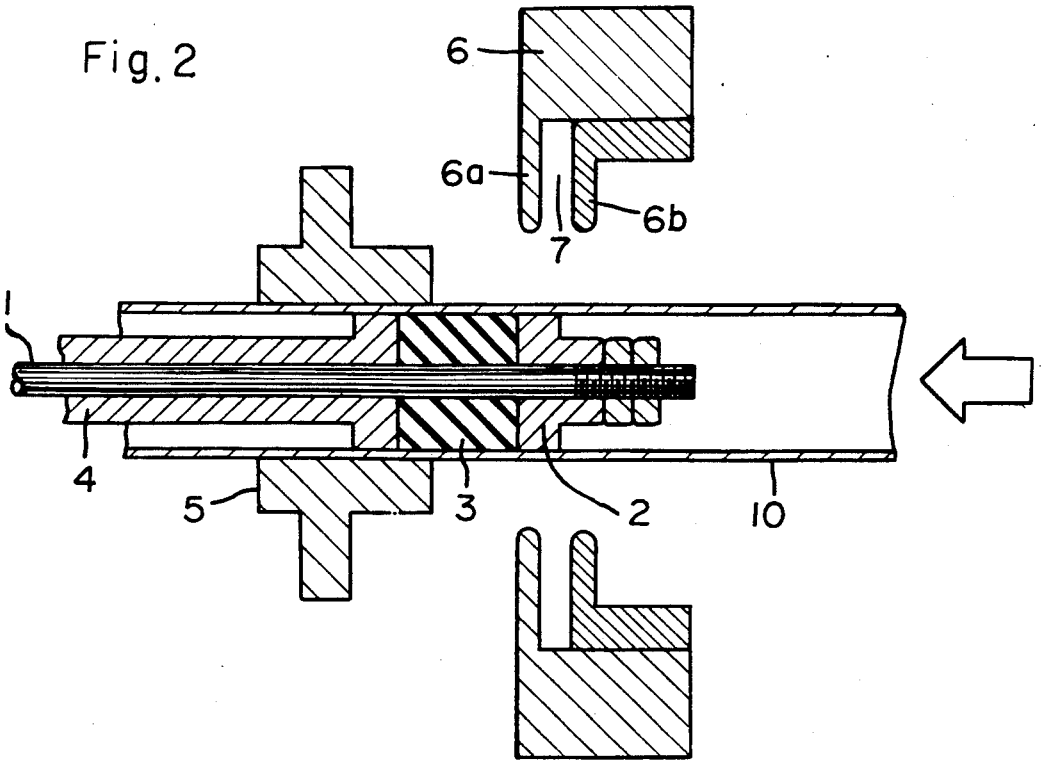
FIGS. 2 through 10 are explanatory views showing the manufacturing steps of the embodiment of the present invention.

FIG. 2 shows the step of setting the raw pipe 10 being deformed. That is, the pipe 10 is inserted and loosely fitted on the collar 4 from the side of the stopper 2. In this step, the chuck feed cylinder 17 is actuated to bring the deforming surface of the arm **6*a* of the chuck 6 close to the boundary between the elastic body 3 and the stopper 2, and the chuck operating cylinder 16 is actuated to sufficiently separate the chuck 6 from the pipe 10. Here, the groove 7 between the arms 6*a* and 6*b*** is previously set to have a given spacing.

Figure 3:
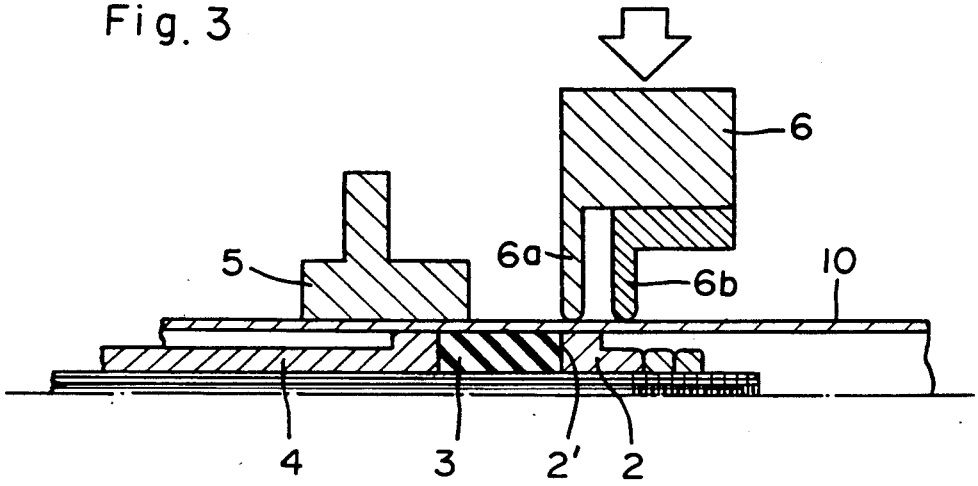

FIG. 3 shows the step of holding by the chuck 6. That is, the chuck operating cylinder 16 is actuated to shift the chuck 6 such that the points of the arms **6*a* and 6*b* cause the circumference of the pipe 10 to come into contact with the circumference of the stopper 2**.

The foregoing steps of FIGS. 2 and 3 complete the preparation of manufacture of a bellows pipe.

Figure 4:
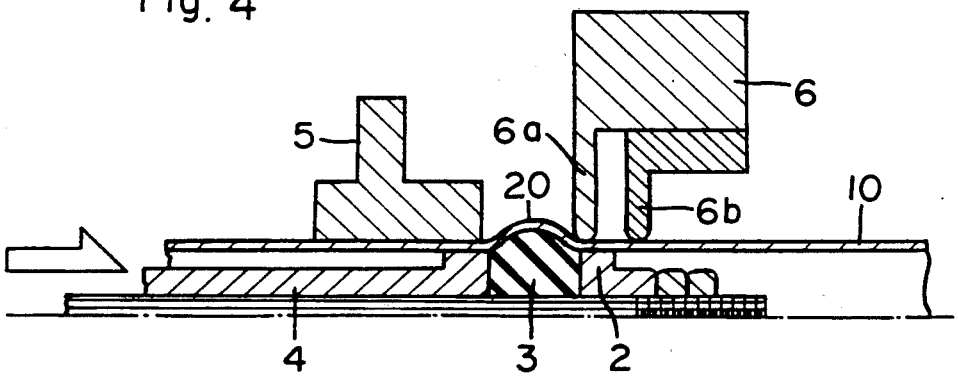
Figure 5:
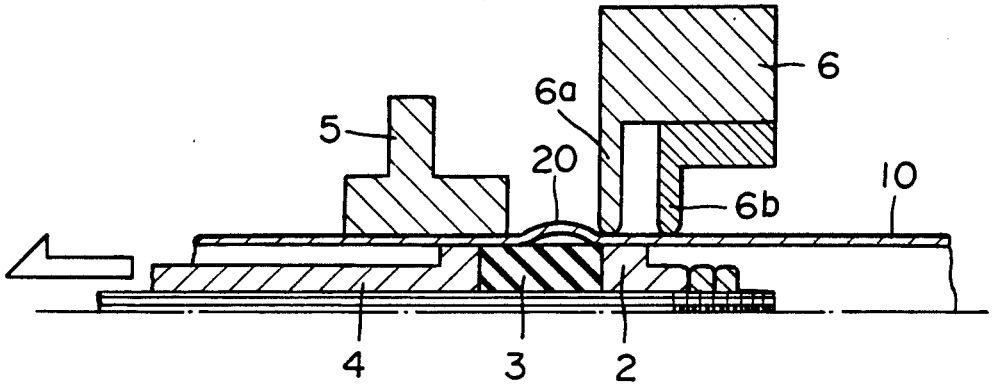

In the (first) step of forming an annular convex portion as shown in FIGS. 4 and 5, an annular convex portion 20 is formed in the pipe 10. That is, while holding the pipe 10 by the arms **6*a* and 6*b* with the chuck 6 kept stationary, the cylinder 8 is actuated to shift the collar 4 a given distance toward the chuck 6, so that the elastic body 3 is resiliently expanded radially of the pipe 10; as a result, the annular convex portion 20 radially expanded is formed in the pipe 10**.

After the annular convex portion 20 is formed in the pipe 10 by shifting the collar 4 a given distance as described above, as shown in FIG. 5, the cylinder 8 is actuated to shift the collar 4 so as to separate from the chuck 6 and return to the initial position, so that the elastic body 3 recovers its original shape.

Figure 6:
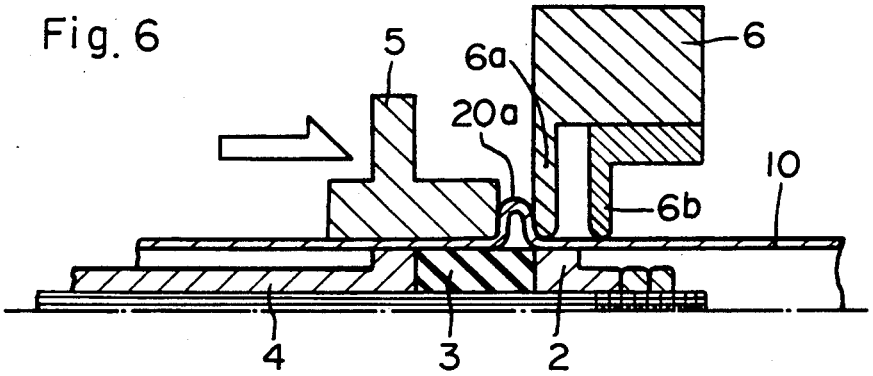
Figure 7:
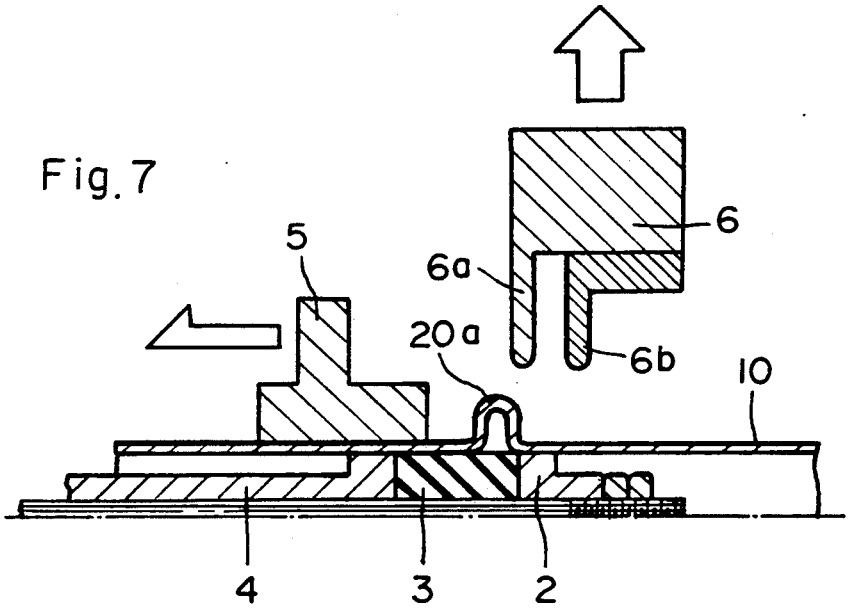

In the (second) step of forming a bellows portion as shown in FIGS. 6 and 7, the annular convex portion 20 formed in the pipe 10 in the first step is changed to a bellows portion 20*a*. That is, as shown in FIG. 6, while holding the pipe 10 by the arms 6*a* and 6*b* with the chuck 6 kept stationary, the cylinders 9 and 9' are actuated to shift the punch 5 a given distance toward the chuck by means of the punch drive shafts 13 and 13', so that the annular convex portion 20 is pinched between the opposing surfaces of the punch 5 and the chuck 6, becoming the bellows portion 20*a*. In this step, the bellows portion 20*a* is shaped such that its finished width is slightly smaller than the spacing 7 of the arms 6*a* and 6*b*.

After the bellows portion 20*a* is formed in the circumference of the pipe 10, as shown in FIG. 7, the cylinders 9 and 9' are actuated to return the punch 5 to the initial position, and the chuck operating cylinders 16 and 16' are actuated to shift the chuck 6 so as to separate from the pipe 10.

Figure 8:
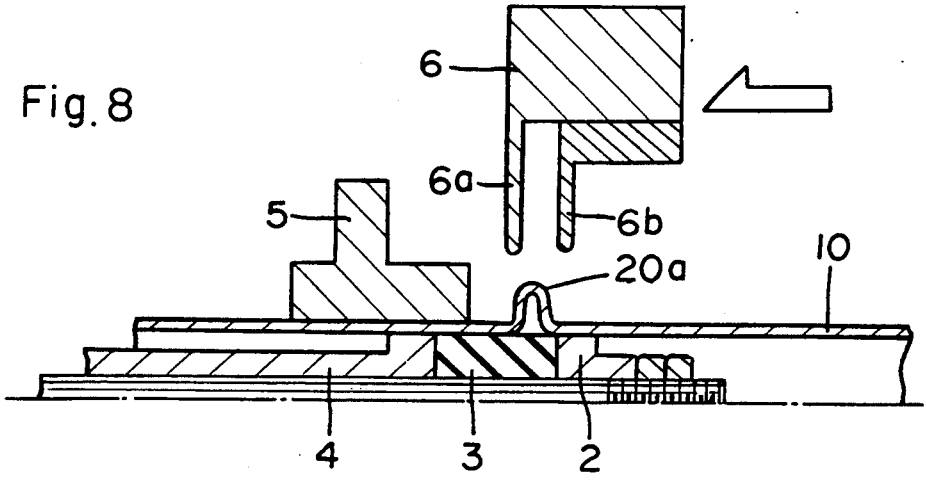
Figure 9:
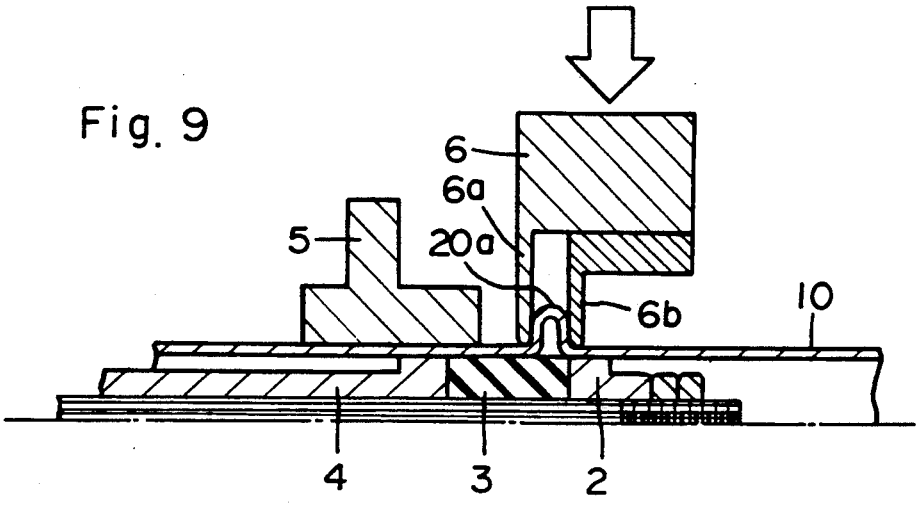
Figure 10:
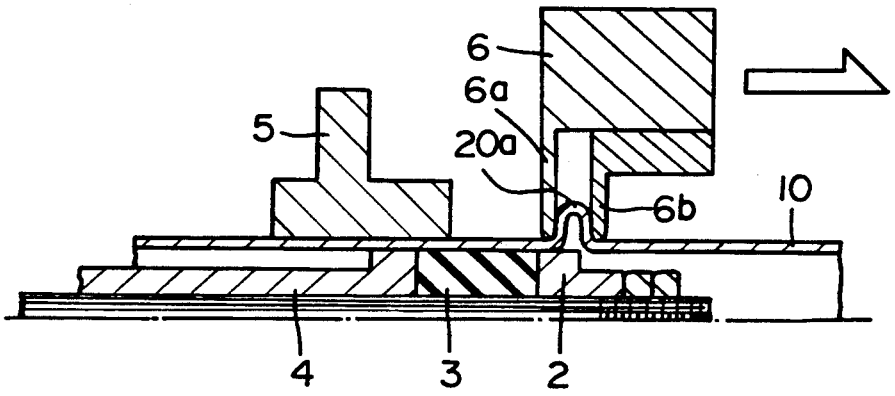

In the (third) step of shifting as shown in FIGS. 8 through 10, the pipe 10 with the bellows portion 20*a* formed in the circumference thereof in the second step is shifted to the position where a next bellows portion is to be formed. That is, as shown in FIG. 8, the chuck feed cylinder 17 is actuated to shift the chuck mount 6*c* such that the arms 6*a* and 6*b* of the chuck 6 come to a position above the bellows portion 20*a* formed in the second step where they can pinch the bellows portion 20*a*. At this position, the chuck operating cylinders 16 and 16' are actuated to bring the chuck 6 close to the pipe; as a result, the bellows portion 20*a* is pinched by the arms 6*a* and 6*b* as shown in FIG. 9. Then, the chuck feed cylinder 17 is actuated to shift the chuck 6 and the pipe 10 such that the deforming surface of the arm 6*a* comes to the boundary between the elastic body 3 and the stopper 2.

Then, a next portion to be deformed of the pipe 10 lying between the arm 6*a* and the punch 5 is subjected to the foregoing first to third steps; as a result, a next bellows portion adjacent to the bellows portion 20*a* is formed. In this way, a bellows pipe is manufactured from the raw pipe 10 by repeating the foregoing steps.

According to the embodiment of the present invention, the elastic body 3 does not expand into the chuck 6; thus, no excessive force is applied to the elastic body 3, causing no damage, and the clamping force of the chuck 6 is not necessary to be large.

In the first and second steps, a portion of the pipe 10 extending from the arm 6*a* to the punch 5 can shift freely in accordance with the deformation of the pipe 10; thus, the thickness of the pipe can never decrease, and no tight sliding arises between the pipe and the elastic body 3.

Further, the elastic body 3 never eats into the gap of the bellows portions even during continuous shaping of the bellows portion, and no groove for defining the shape of the bellows portion is formed in the punch 5 and the chuck 6; thus, the outer diameter and pitch of the bellows portion can be readily changed by adjusting the spacing between the punch 5 and the chuck 6 and the stroke of the punch 5, and the length of the pipe 10 being deformed is not limited.

Although not included in the embodiment, a jig for determining the insertion position of the pipe may be mounted on the base.

As described above in greater detail, according to the present invention, the length of the pipe being deformed is not limited, the thickness of the pipe decreases little through deforming, no damage is given to the elastic body, and a variety of bellows shape can be reliably produced with high efficiency.

What is claimed is:

1. A method of manufacturing a bellows pipe having opposed first and second longitudinal ends, said method comprising the steps of:

providing an elongated collar dimensioned to be inserted into the pipe;

providing an elastic body at one longitudinal end of the collar, said elastic body, in an unbiased condition, being dimensioned to be inserted in to the pipe;

providing a stopper adjacent the elastic body, said stopper being dimensioned to be inserted in to the pipe and being selectively movable toward and away from the collar for selectively expanding the elastic body radially outwardly between the stopper and the collar;

inserting the stopper, elastic body and collar into the pipe;

providing a punch around the pipe at a location intermediate the first and second ends thereof, said punch being selectively moveable toward and away from the second end of the pipe;

providing a chuck around the pipe intermediate the punch and the second end thereof, said chuck comprising first and second axially spaced apart arms selectively moveable in radial directions toward and away from the pipe and in axial directions toward and away from the punch;

pressing the elastic body in the axial direction of the pipe between the collar and the stopper to resiliently expand the elastic body radially of the pipe such that a circumferential portion of the pipe changes to an annular convex portion, permitting the elastic body to return to an unexpanded condition, compressing the annular covex portion between the chuck and the punch to form a bellows portion, moving the chuck sequentially outwardly away from the pipe, longitudianally toward the punch and then inwardly toward the pipe to pinch the bellows portion between the arms of the chuck, moving the chuck longitudinally away from the punch for shifting the pipe to a given position while continuing the pinching of the bellows portion by the chuck, wherein a plurality of bellows portions spaced a given distance from each other are successively formed by repeating the steps from the pressing from the elastic body.

2. A device for deforming a raw pipe into a bellows pipe comprising a base, a support member secured on the base, a core member extending along the base and having opposed first and second ends, the first end being secured to the support member, a collar slidably fitted on the core member on which the raw pipe is loosely fitted, an end of the collar being larger than remaining portions of the collar and defining a diameter slightly smaller than the inner diameter of the pipe, a stopper secured to the end of the core member, the stopper defining a diameter substantially equal to the diameter of the large end of the collar, an elastic body slidably fitted on the core member between the large end of the collar and the stopper, a first drive means attached to the support member for mechanically driving the collar along the core member a selected distance alternatively toward and away from the stopper, such that movement of the collar towards the stopper expands the elastic body a selected amount and such that movement of the collar away from the stopper permits the elastic body to return to an unexpanded condition, a chuck having parallel arms projecting therefrom toward the core member orthogonally thereto, spacing of the arms being adjustable, a second drive means for shifting the chuck to approach and separate from the pipe, a third drive means for shifting the chuck along the pipe, a punch loosely fitted on the pipe, and a fourth drive means for shifting the punch along the pipe after the first drive means has moved the collar away from the stopper such that the elastic body is returned to its unexpanded condition before punch is moved.

3. A bellows pipe manufacturing device according to claim 2, wherein the elastic body is made of urethane rubber.

4. A bellows pipe manufacturing device according to claim 2, wherein the spacing of the arms of the chuck is slightly larger than a finished width of a bellows portion.

5. A bellows pipe manufacturing device according to claim 2, wherein each of the drive means comprises a cylinder.

* * * * *